US010391795B2

(12) United States Patent
Abe

(10) Patent No.: US 10,391,795 B2
(45) Date of Patent: Aug. 27, 2019

(54) TARGET TRANSPORT APPARATUS AND LIQUID EJECTING APPARATUS

(71) Applicant: Seiko Epson Corporation, Tokyo (JP)

(72) Inventor: Takahiro Abe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/794,657

(22) Filed: Oct. 26, 2017

(65) Prior Publication Data

US 2018/0043708 A1 Feb. 15, 2018

Related U.S. Application Data

(60) Continuation of application No. 14/862,826, filed on Sep. 23, 2015, now Pat. No. 9,802,428, which is a division of application No. 13/681,457, filed on Nov. 20, 2012, now abandoned.

(30) Foreign Application Priority Data

Nov. 24, 2011 (JP) ..... 2011-255860

(51) Int. Cl.

| | |
|---|---|
| ***B41J 13/02*** | (2006.01) |
| ***B41J 15/16*** | (2006.01) |
| ***B41J 2/01*** | (2006.01) |
| ***B41J 11/00*** | (2006.01) |
| ***B41J 11/42*** | (2006.01) |

(52) U.S. Cl.

CPC ..... *B41J 13/02* (2013.01); *B41J 2/01* (2013.01); *B41J 11/002* (2013.01); *B41J 11/42* (2013.01); *B41J 15/16* (2013.01)

(58) Field of Classification Search

CPC . B41J 13/02; B41J 11/42; B41J 11/002; B41J 15/16; B41J 2/01

See application file for complete search history.

(56) References Cited

U.S. PATENT DOCUMENTS 5,041,846 A 8/1991 Vincent et al.
7,458,655 B2 * 12/2008 Takahashi ..... B41J 25/308 347/104
8,500,119 B2 * 8/2013 Hamada ..... B65H 5/062 271/227

(Continued)

FOREIGN PATENT DOCUMENTS

JP 08-259029 A 10/1996
JP 2004-075368 A 3/2004

(Continued)

*Primary Examiner* — Justin Seo
(74) *Attorney, Agent, or Firm* — Workman Nydegger

(57) ABSTRACT

A target transport apparatus includes a transport roller pair that has a plurality of segmented roller members disposed at intervals in a width direction that intersects with a transport direction of continuous paper and that imparts a transport force on the continuous paper by the segmented roller members pinching the continuous paper; and an image capturing unit, disposed in a location that corresponds to a pinched area in the width direction of the continuous paper that is pinched by the segmented roller members and to the pinched area along the transport direction, that detects, without making contact with the continuous paper, an amount by which the continuous paper is transported by the transport roller pair.

8 Claims, 4 Drawing Sheets

(56) References Cited

U.S. PATENT DOCUMENTS

| | | | |
|---|---|---|---|
| 2007/0023997 | A1 | 2/2007 | Ertel et al. |
| 2009/0322819 | A1 | 12/2009 | Hayashi et al. |
| 2011/0102850 | A1 | 5/2011 | Watanabe |
| 2013/0127943 | A1 | 5/2013 | Abe |
| 2013/0135407 | A1 | 5/2013 | Abe |
| 2013/0135415 | A1 | 5/2013 | Claramunt et al. |
| 2016/0009110 | A1 | 1/2016 | Abe |

FOREIGN PATENT DOCUMENTS

| | | | |
|---|---|---|---|
| JP | 2005-271293 | A | 10/2005 |
| JP | 2007-217176 | A | 8/2007 |
| JP | 2010-099920 | A | 5/2010 |
| JP | 2011-093241 | A | 5/2011 |
| JP | 2011-255860 | A | 12/2011 |
| JP | 2013-107351 | A | 6/2013 |

* cited by examiner

TARGET TRANSPORT APPARATUS AND LIQUID EJECTING APPARATUS

The present application is a continuation of U.S. application Ser. No. 14/862,826, filed Sep. 23, 2015, which is a continuation of U.S. application Ser. No. 13/681,457, filed Nov. 20, 2015, which claims priority under 35 U.S.C. § 119 to Japanese Application No. 2011-255860, filed Nov. 24, 2011, which are hereby incorporated by reference in their entireties.

BACKGROUND

1. Technical Field

The present invention relates to target transport apparatuses that transport a target and liquid ejecting apparatuses provided with such target transport apparatuses.

2. Related Art

Thus far, ink jet printers that form images by ejecting a liquid from a liquid ejecting head onto a target have been known as one type of liquid ejecting apparatus. For example, with the printer disclosed in JP-A-2005-271293, a transport roller pair that imparts a transport force on paper (a target) while pinching that paper is provided in a transport path of the paper. This transport roller pair is configured of a transport driving roller and a transport slave roller, and by configuring the transport slave roller of a plurality of segmented roller members disposed at intervals in the width direction of the paper, the paper that is fed out from the transport roller pair is suppressed from meandering in the width direction.

In addition, in recent years, printers provided with sensors for monitoring amounts by which a target is transported by such a transport roller pair are being proposed. For example, in the printer disclosed in JP-A-2007-217176, an image capturing device that continuously captures an image of the surface of recording paper (a target) is provided as such a sensor. According to this printer, an amount by which the recording paper, on which a transport force is imparted by being pinched between a transport driving roller and a transport slave roller, is moved is detected based on the amount of movement of a specific image pattern that follows the relief of the surface of the recording paper contained in an image obtained from the image capturing device.

Incidentally, according to the printer disclosed in JP-A-2007-217176, the transport slave roller is configured as a plurality of segmented roller members disposed at intervals in the width direction of the recording paper in order to suppress the recording paper from meandering in the width direction. In this case, because the areas of the recording paper corresponding to the spaces between adjacent segmented roller members in the width direction are not pinched between the transport driving roller and the transport slave roller, if the recording paper absorbs ink (a liquid) ejected from a recording head (a liquid ejecting head) and wets and swells as a result, the recording paper will deform locally. The distance between the image capturing device and the recording paper will thus change; as a result, the image capturing device cannot clearly capture the relief on the surface of the recording paper, leading to a risk that the amount by which the recording paper is transported cannot be accurately detected.

SUMMARY

An advantage of some aspects of the invention is to provide a target transport apparatus and a liquid ejecting apparatus capable of accurately detecting an amount by which a target is transported while suppressing the target from meandering.

A target transport apparatus according to an aspect of the invention includes: a transport unit that has a plurality of pinching portions disposed at intervals in a width direction that intersects with a transport direction of a target and that imparts a transport force on the target by the pinching portion pinching the target; and a transport amount detection unit, disposed in a location that corresponds to a pinched area in the width direction of the target that is pinched by the pinching portion and to the pinched area along the transport direction, that detects, without making contact with the target, an amount by which the target is transported by the transport unit.

According to this configuration, even if warping has occurred in the width direction of the target when the transport force is imparted on the target by the transport unit, the pinched area of the target in the width direction thereof, and a regional area of the target that corresponds to the pinched area along the transport direction of the target, experience almost no deformation. For this reason, the distance between the transport amount detection unit, which takes that regional area as a detection target, and the target undergoes almost no change. Accordingly, the amount by which the target is transported can be accurately detected by the transport amount detection unit that is disposed at the pinched area of the target and through which the regional area that corresponds thereto along the transport direction passes, while the target is suppressed from meandering in the width direction by the plurality of pinching portions that are disposed at intervals in the width direction of the target.

According to another aspect of the invention, in the target transport apparatus, it is preferable that the transport amount detection unit be disposed downstream from the transport unit in the transport direction of the target.

According to this configuration, of the target that is transported by the transport unit, the transport amount detection unit takes, as a target of detection, the pinched area that is pinched by the pinching portion in the width direction of the target and the regional area that corresponds to the pinched area along the transport direction. Accordingly, the distance between the target transported by the transport unit and the transport amount detection unit undergoes almost no change, and thus the transport amount detection unit can accurately detect the amount by which the target is transported.

According to another aspect of the invention, it is preferable that the target transport apparatus further include a support member that supports the target transported by the transport unit, and the transport amount detection unit detect the amount by which the target is transported from the surface of the target that is supported by the support member.

According to this configuration, the distance between the target and the transport amount detection unit does not change even if the thickness of the target supported by the support member changes. Accordingly, the amount by which the target is transported can be accurately detected without being influenced by the thickness of the target.

According to another aspect of the invention, in the target transport apparatus, it is preferable that the transport amount detection unit be disposed in a location that corresponds to the center of the pinched area in the width direction of the target and to the center of the pinched area along the transport direction.

According to this configuration, even if warping has occurred in the width direction of the target when the transport force is imparted on the target by the transport unit, the area of the target in the center of the pinched area that is pinched by the pinching portions in the width direction thereof, and the regional area of the target that corresponds to the stated center along the transport direction of the target, are particularly suppressed from deforming with certainty. Accordingly, by suppressing changes in the distance between the transport amount detection unit, which takes that regional area as a detection target, and the target with more certainty, the amount by which the target is transported can be more accurately detected by the transport amount detection unit.

According to another aspect of the invention, it is preferable that a liquid ejecting apparatus include a liquid ejecting head that ejects a liquid onto a target and a target transport apparatus having the aforementioned configuration.

According to this configuration, the same effects as those of the aforementioned target transport apparatus can be achieved.

According to another aspect of the invention, in the liquid ejecting apparatus, it is preferable that the liquid ejecting head be provided downstream from the transport unit in the transport direction of the target, and eject a liquid onto the target that is pinched by the transport unit.

According to this configuration, even if the target has absorbed liquid ejected from the liquid ejecting head and has expanded as a result, the pinched area of the target in the width direction thereof that is pinched by the pinching portions, and the regional area that corresponds to the pinched area along the transport direction, experience almost no deformation. Accordingly, the distance between the transport amount detection unit, which takes that regional area as a detection target, and the target undergoes almost no change, and thus the amount by which the target is transported can be more accurately detected by the transport amount detection unit.

According to another aspect of the invention, it is preferable that the liquid ejecting apparatus further include a heating unit that heats and fixes the liquid ejected onto the target from the liquid ejecting head.

According to this configuration, even if the target has been heated by the heating unit and has expanded as a result, the pinched area of the target in the width direction thereof that is pinched by the pinching portions, and the regional area that corresponds to the pinched area along the transport direction, experience almost no deformation. Accordingly, the distance between the transport amount detection unit, which takes that regional area as a detection target, and the target undergoes almost no change, and thus the amount by which the target is transported can be more accurately detected by the transport amount detection unit.

BRIEF DESCRIPTION OF THE DRAWINGS

The invention will be described with reference to the accompanying drawings, wherein like numbers reference like elements.

FIG. 4A is a plan view and FIG. 4B is a front view seen from the downstream side in the transport direction of the continuous paper.

DESCRIPTION OF EXEMPLARY EMBODIMENTS

Hereinafter, a specific embodiment of an ink jet printer, serving as a type of a liquid ejecting apparatus according to the invention, will be described with reference to FIGS. 1 through 4.

Figure 1:
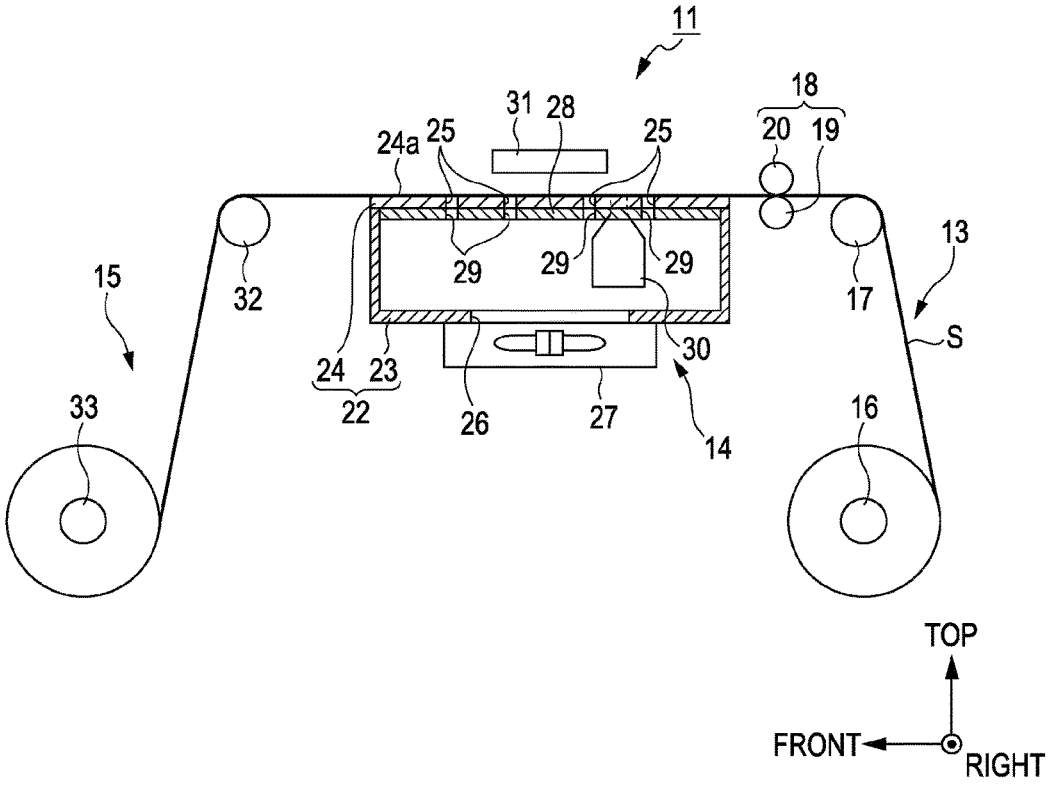
FIG. 1 is a schematic diagram illustrating a printer according to an embodiment of the invention.

As shown in FIG. 1, a printer 11 includes a feeding unit 13 that feeds out continuous paper S serving as an oblong target, a recording unit 14 that executes a recording process by ejecting ink (a liquid) on the continuous paper S that has been fed out, and a take-up unit 15 that takes up the continuous paper S on which the recording process has been executed by the recording unit 14.

In other words, the feeding unit 13 is disposed in a position that is toward the rear of the continuous paper S, which corresponds to the upstream side of the transport direction, and the take-up unit 15 is disposed in a position that is toward the front, which corresponds to the downstream side. The recording unit 14 is disposed in a position partway along the transport path, between the feeding unit 13 and the take-up unit 15.

A winding shaft 16 that extends in the left-right direction (the direction orthogonal to the paper surface) is provided, in a rotatable state, in the feeding unit 13. The continuous paper S is wound into a roll shape in advance and supported on the winding shaft 16, so as to be capable of rotating with the winding shaft 16. In other words, the continuous paper S is fed out from the winding shaft 16 as a result of the winding shaft 16 rotating, and is transported downstream in the transport direction.

Meanwhile, a first intermediate roller 17 upon which the continuous paper S that has been fed out from the winding shaft 16 is wrapped upon and that guides the continuous paper S to the recording unit 14 is provided above and slightly forward from the winding shaft 16, extending in the left-right direction and capable of rotation. When the continuous paper S that has been fed out from the winding shaft 16 is wrapped upon the first intermediate roller 17 from the lower-rear, the transport direction of the continuous paper S is converted to the horizontal direction.

Figure 2:
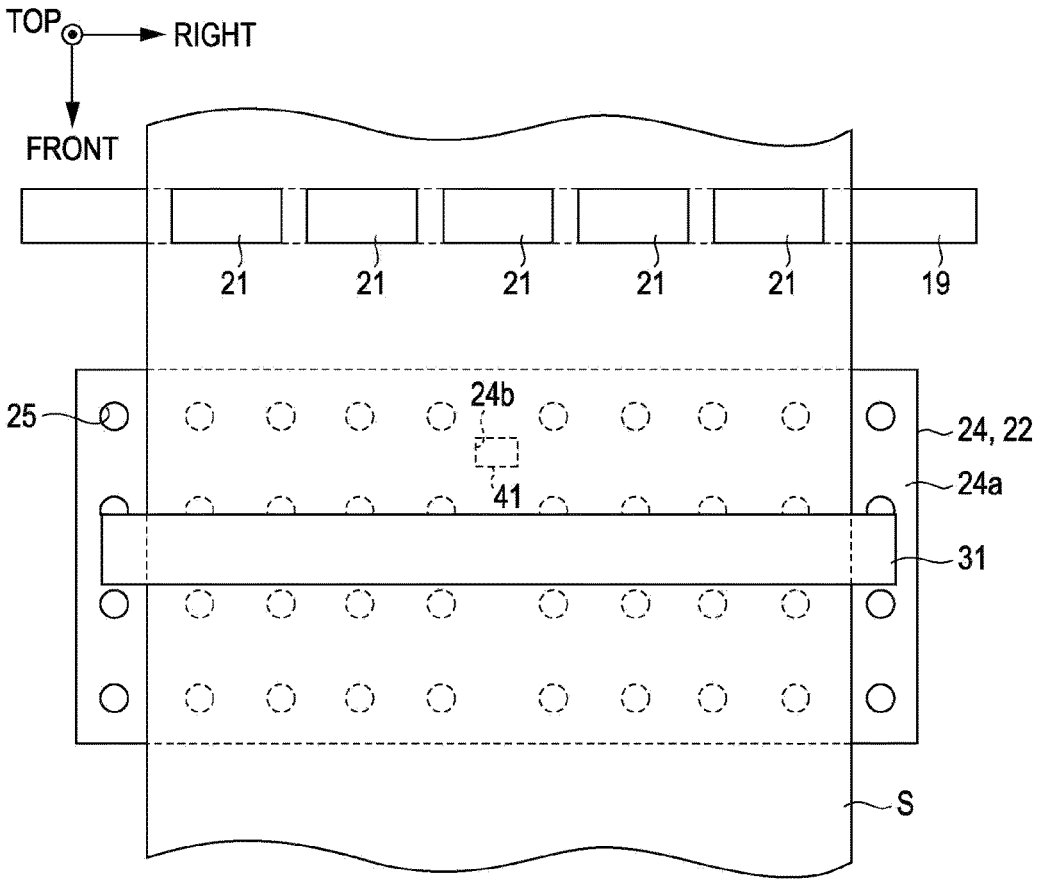
FIG. 2 is a plan view of a recording unit.

Meanwhile, a transport roller pair 18, serving as a transport unit, is provided in a position that is downstream from the first intermediate roller 17 in the transport direction of the continuous paper S, and is thus forward from the first intermediate roller 17. The transport roller pair 18 is configured of a driving roller 19 and a slave roller 20. As shown in FIG. 2, the driving roller 19 extends across the entirety of the width direction of the continuous paper S. On the other hand, the slave roller 20 extends parallel to the driving roller 19 in the left-right direction that corresponds to the width direction of the continuous paper S, but is configured of a plurality (in this embodiment, five) segmented roller members 21 that are disposed at intervals in the left-right direction and that serve as pinching portions. Note that the segmented roller members 21 are disposed at equal intervals in the left-right direction that corresponds to the width direction of the continuous paper S. A transport force that moves the continuous paper S toward the recording unit 14 is imparted on the continuous paper S by the segmented roller members 21 undergoing slave rotation in response to driving rotation of the driving roller 19 while the continuous paper S is pinched between the driving roller 19 and the segmented roller members 21.

As shown in FIG. 1, a support platform 22 that serves as a support member capable of supporting the continuous paper S is provided in the recording unit 14. The support platform 22 is configured of a main body unit 23 formed in an open-ended, approximately box shape whose upper side is open, and a support plate 24, having a rectangular plate shape, that closes the opening in the upper side of the main body unit 23. Multiple suction holes 25 that pass through the support plate 24 in the thickness direction, or from top to bottom, thereof are formed in the support plate 24. In addition, an opening portion 26 is provided in the center of the bottom surface of the main body unit 23, and a suction fan 27 is provided so as to cover the opening portion 26. In addition, a heater 28 that serves as a heating unit and that has a rectangular plate shape that corresponds to the support plate 24 when viewed from above is provided within the main body unit 23. The heater 28 makes contact with the support plate 24 from the rear surface side (the bottom side) of a support surface 24*a*. The heater 28 emits heat when a current is supplied from a power source (not shown), and heats the entire support surface 24*a* of the support plate 24 in an essentially uniform manner. Accordingly, the heat from the heater 28 is transmitted to the continuous paper S via the support plate 24.

In addition, through-holes 29 that pass through the heater 28 from top to bottom are formed in locations of the heater 28 that correspond to the suction holes 25 of the support plate 24. When the suction fan 27 is driven, the interior of the main body unit 23 is sucked via the opening portion 26, and a negative pressure is produced within the through-holes 29 and the suction holes 25; due to this negative pressure being produced, the continuous paper S is sucked onto the support surface 24*a* of the support plate 24. Note that an image capturing unit 30, serving as a transport amount detection unit for non-contact detection of an amount by which the continuous paper S is transported, is embedded in the support surface 24*a* of the support plate 24. In other words, the image capturing unit 30 is disposed downstream from the transport roller pair 18 in the transport direction of the continuous paper S.

Meanwhile, a line-head type recording head 31 that serves as a liquid ejecting head is provided in a location of the recording unit 14 that corresponds to the support platform 22. The bottom surface of the recording head 31 serves as a nozzle formation surface in which a plurality of nozzles (not shown) that eject ink are provided. The recording head 31 extends in the horizontal direction and in a direction orthogonal to the transport direction of the continuous paper S, and has a length in the lengthwise direction that corresponds to the maximum paper width of the continuous paper S. The recording head 31 executes a recording process by ejecting ink onto the continuous paper S that is pinched and transported by the transport roller pair 18.

In addition, a second intermediate roller 32 that opposes the first intermediate roller 17 with the support platform 22 located therebetween is provided on the front side of the support platform 22 so as to extend parallel to the first intermediate roller 17. The first intermediate roller 17 and the second intermediate roller 32 are positioned so that the apex areas of the circumferential surfaces of those respective rollers are at the same height as the support surface 24*a* of the support plate 24. Accordingly, the continuous paper S is transported toward the front, which corresponds to the downstream direction, while sliding along the support surface 24*a* of the support plate 24. Then, the continuous paper S is wrapped upon the second intermediate roller 32 from the upper-front; this converts the transport direction of the continuous paper S from the horizontal direction to a lower-front angle direction, after which the continuous paper S is transported to the take-up unit 15.

A take-up shaft 33 that is capable of rotational driving is provided in the take-up unit 15, in a lower-front angle direction of the second intermediate roller 32. The leading end of the continuous paper S, which corresponds to the downstream end in the transport direction, is taken up by the take-up shaft 33 as a result of the rotational driving of the take-up shaft 33.

Next, the image capturing unit 30 will be described.

Figure 3:
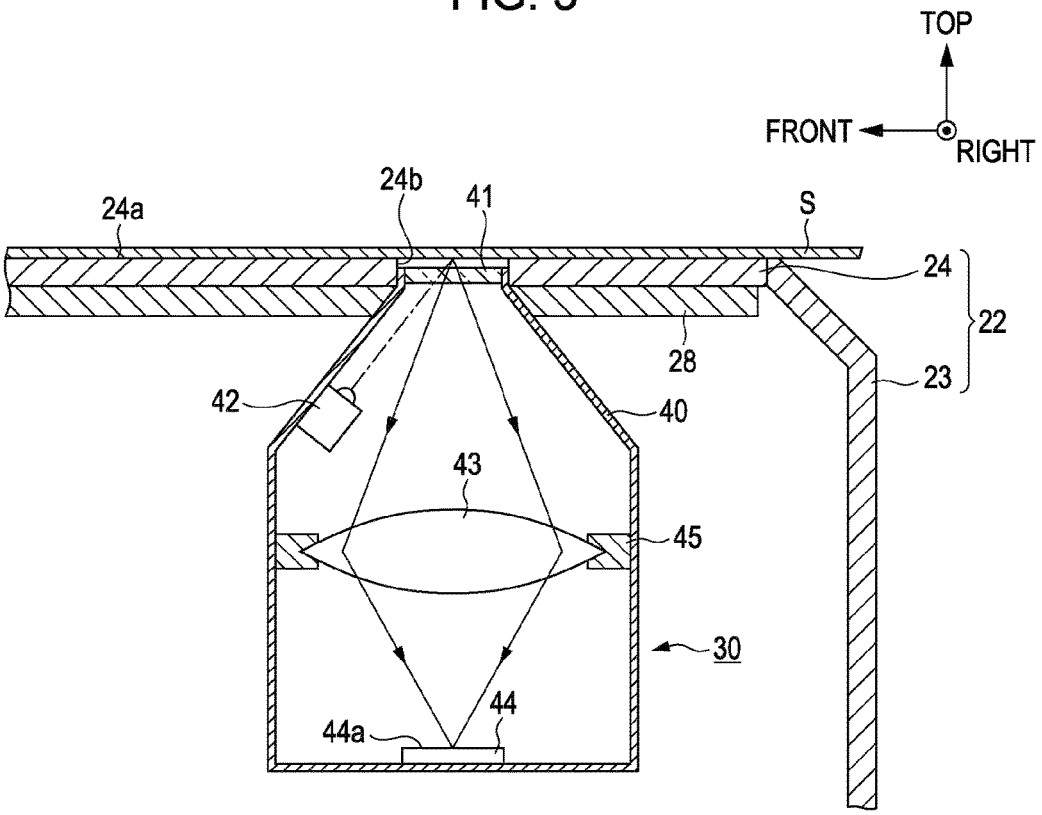
FIG. 3 is a cross-sectional view of an image capturing unit.

As shown in FIG. 3, a case 40 that configures an outer housing of the image capturing unit 30 has a light-transmissive glass 41 attached to a leading end portion (upper end portion) of the case 40, the leading end portion being formed in a shape of a cylinder with a circular truncated cone thereon. The image capturing unit 30 is then mounted in the support platform 22, with the light-transmissive glass 41 being embedded in a hole 24*b* formed in the support surface 24*a* of the support plate 24. Note that because the upper surface of the light-transmissive glass 41 is positioned lower than the support surface 24*a* of the support plate 24, the light-transmissive glass 41 does not make contact with the continuous paper S located upon the support surface 24*a* of the support plate 24.

A light emitting unit 42 configured of, for example, a light-emitting diode (LED) is provided within the case 40. This light emitting unit 42 is fixed to an inner wall surface of the case 40 at an angled orientation that enables light to be emitted toward the light-transmissive glass 41. In addition, a focusing lens 43 is provided in the case 40, the focusing lens 43 focusing light that has been emitted from the light emitting unit 42, passed through the light-transmissive glass 41, reflected off the rear surface of the continuous paper S, passed through the light-transmissive glass 41 again, and entered into the case 40. Furthermore, an image sensor 44 having an imaging surface 44*a* on which is formed an image of the rear surface of the continuous paper S onto which light has been focused by the focusing lens 43 is provided within the case 40. The image sensor 44 is configured of, for example, a two-dimensional image sensor. Note that the focusing lens 43 is held, by a holding member 45, at a height at which an image of the rear surface of the continuous paper S can be formed on the imaging surface 44*a* of the image sensor 44. The image capturing unit 30 then captures an image of the texture (a paper pattern) of the continuous paper S on the surface of the side of the continuous paper S that is supported by the support plate 24 and, by comparing two images captured in sequence during a set time interval, calculates an amount by which the continuous paper S is transported per unit of time.

Note that as shown in FIG. 2, the light-transmissive glass 41 is disposed in a location of the support surface 24*a* of the support plate 24 that is in the center thereof in the width direction of the continuous paper S. The light-transmissive glass 41 is disposed in a location that corresponds, in the transport direction of the continuous paper S, to the segmented roller member 21 that, of the segmented roller members 21 that configure the slave roller 20, is located in the center. To be more specific, the light-transmissive glass 41 is disposed in a location that corresponds, in the transport direction of the continuous paper S, to a central area of the segmented roller member 21 in the axis line direction thereof. In other words, the light-transmissive glass 41 is disposed at a central area of the continuous paper S, in the width direction thereof, of a pinched area that is pinched by the segmented roller member 21, and in an area that corresponds to that area along the transport direction of the continuous paper S.

Next, operations of the printer 11 configured in this manner will be described, paying particular attention to the operations carried out when the image capturing unit 30 detects the amount by which the continuous paper S is transported.

When ink is ejected from the recording head 31 onto the continuous paper S that is positioned upon the support surface 24*a* of the support plate 24, the continuous paper S absorbs the ink, resulting in wetting and swelling therein; as a result, the continuous paper S expands. In addition, the continuous paper S that is positioned upon the support surface 24*a* of the support plate 24 also expands when the heater 28 applies heat thereto in order to heat and fix the ink that has been ejected from the recording head 31. In this case, because the continuous paper S is sucked onto the support surface 24*a* of the support plate 24 by the suction fan 27, the continuous paper S has difficulty extending to both sides in the width direction. Accordingly, the continuous paper S tends to deform in the direction that lifts off from the support surface 24*a* of the support plate 24.

Figure 4A:
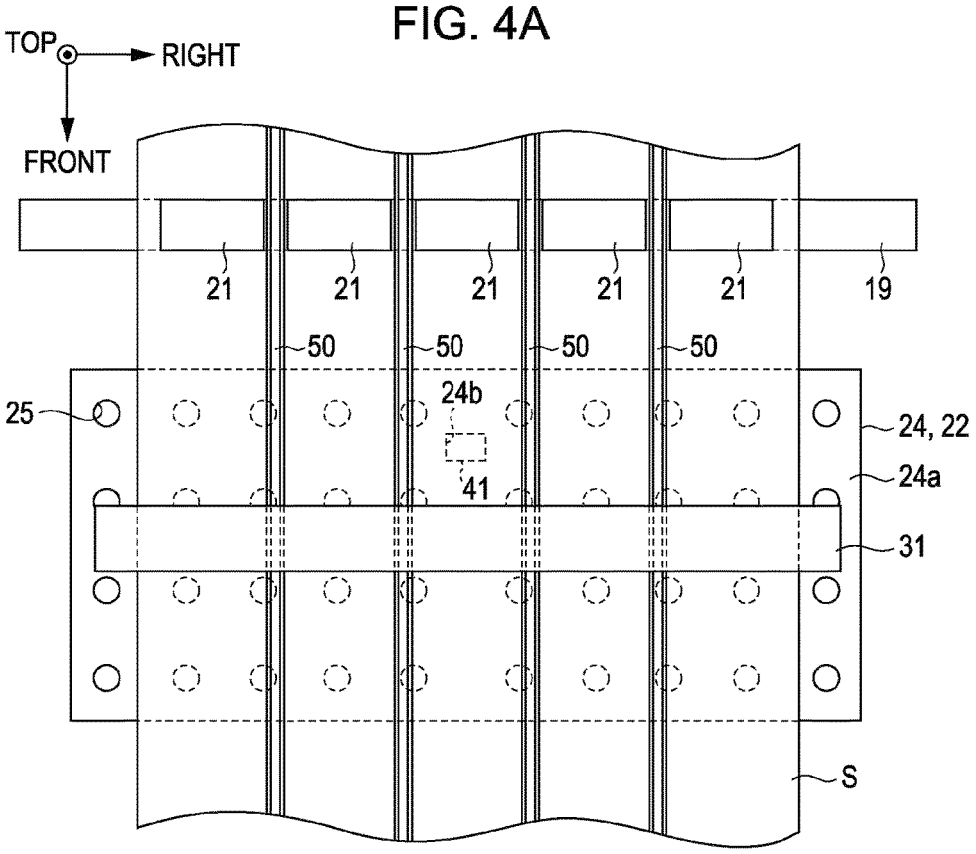
FIGS. 4A and 4B are diagrams illustrating the recording unit in a state where warped areas are formed in continuous paper, where
Figure 4B:
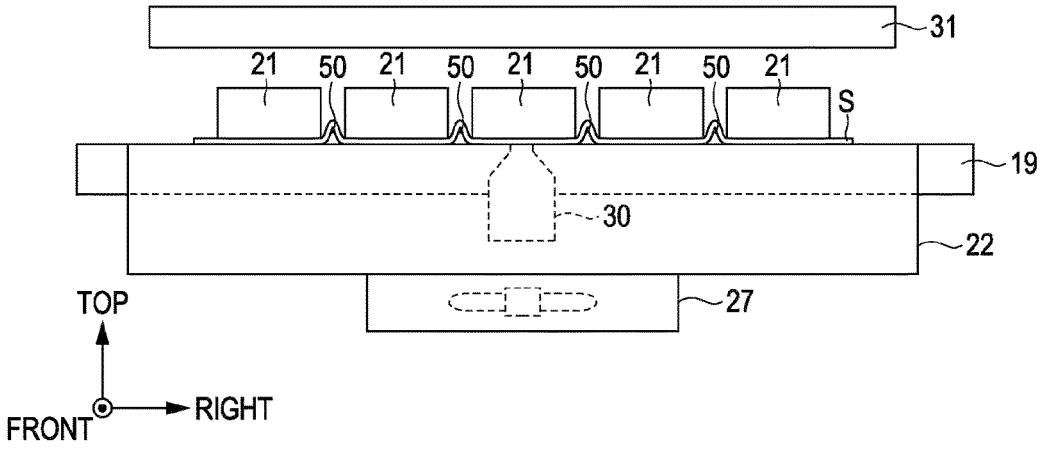

Here, the portions of the continuous paper S in the width direction thereof that are pinched between the driving roller 19 and the slave roller 20, as well as the portions of the continuous paper S in the transport direction that correspond to the pinched portions, are restricted from deforming in the direction that lifts off from the support surface 24*a* of the support plate 24 due to the expansion of the continuous paper S. However, the portions of the continuous paper S in the width direction thereof that are not pinched between the driving roller 19 and the slave roller 20, as well as the portions of the continuous paper S in the transport direction that correspond to the portions that are not pinched, are allowed to deform in the direction that lifts off from the support surface 24*a* of the support plate 24 due to the expansion of the continuous paper S. As a result, as shown in FIGS. 4A and 4B, the portions of the continuous paper S that correspond, in the width direction thereof, to the areas between adjacent segmented roller members 21 warp and deform in the direction that lifts off from the support surface 24*a* of the support plate 24, and thus warped areas 50 that extend in the transport direction of the continuous paper S are formed in the stated areas.

With respect to this point, in this embodiment, the image capturing unit 30 is provided so that the light-transmissive glass 41, through which light that is incident on the continuous paper S passes, is provided in a location that corresponds to the central area of the segmented roller members 21 in the width direction of the continuous paper S. Accordingly, the area of the continuous paper S that is detected by the image capturing unit 30 experiences almost no deformation, caused by the expansion of the continuous paper S, in a direction that takes this detected area away from the light-transmissive glass 41. As a result, even if the continuous paper S expands, the image capturing unit 30 can maintain the distance between the continuous paper S and the imaging surface 44*a* of the image sensor 44 in the optical axis direction of light reflected from the continuous paper S. Accordingly, an image of the texture of the continuous paper S can be formed clearly on the imaging surface 44*a* of the image sensor 44, and thus the amount by which the continuous paper S is transported is detected accurately based on the amount by which the texture of the continuous paper S has moved as obtained as a result of the imaging performed by the image sensor 44.

According to the embodiment described thus far, the following effects can be achieved.

1. Even if warping has occurred in the width direction of the continuous paper S when the transport force is imparted on the continuous paper S by the transport roller pair 18, the pinched area of the continuous paper S in the width direction thereof that is pinched by the transport roller pair 18, and a regional area of the continuous paper S that corresponds to the pinched area along the transport direction of the continuous paper S, experience almost no deformation. For this reason, the distance between the image capturing unit 30, which takes that regional area as a detection target, and the continuous paper S undergoes almost no change. Accordingly, the amount by which the continuous paper S is transported can be accurately detected by the image capturing unit 30 that is disposed at the pinched area of the continuous paper S that is pinched and at the regional area that corresponds thereto along the transport direction, while the transport roller pair 18 suppresses the continuous paper S from meandering in the width direction using the plurality of segmented roller members 21 that are disposed at intervals in the width direction of the continuous paper S.

2. The image capturing unit 30 detects the amount by which the continuous paper S is transported from the surface of the side of the continuous paper S that is supported by the support plate 24. For this reason, the distance between the continuous paper S and the image capturing unit 30 does not change even if the thickness of the continuous paper S supported by the support plate 24 changes. Accordingly, the image capturing unit 30 can accurately detect the amount by which the continuous paper S is transported without being influenced by the thickness of the continuous paper S.

3. Even if warping has occurred in the width direction of the continuous paper S when the transport force is imparted on the continuous paper S by the transport roller pair 18, the area of the continuous paper S in the center of the segmented roller members 21 in the width direction thereof, and the regional area of the continuous paper S that corresponds to the stated center along the transport direction of the continuous paper S, are particularly suppressed from deforming with certainty. Accordingly, by suppressing changes in the distance between the image capturing unit 30, which takes that regional area as a detection target, and the continuous paper S with more certainty, the amount by which the continuous paper S is transported can be more accurately detected by the image capturing unit 30.

4. Even if the continuous paper S has absorbed ink ejected from the recording head 31 and has expanded as a result, the pinched area of the continuous paper S in the width direction thereof that is pinched by the transport roller pair 18, and the regional area that corresponds to the pinched area along the transport direction, experience almost no deformation. Accordingly, because the distance between the image capturing unit 30, which takes that regional area as a detection target, and the continuous paper S undergoes almost no change, the amount by which the continuous paper S is transported can be more accurately detected by the image capturing unit 30.

5. Even if the continuous paper S has been heated by the heater 28 and has expanded as a result, the pinched area of the continuous paper S in the width direction thereof that is pinched by the transport roller pair 18, and the regional area that corresponds to the pinched area along the transport direction, experience almost no deformation. Accordingly, because the distance between the image capturing unit 30, which takes that regional area as a detection target, and the continuous paper S undergoes almost no change, the amount by which the continuous paper S is transported can be more accurately detected by the image capturing unit 30.

6. The light-transmissive glass 41 is disposed in a location that corresponds to the pinched area of the continuous paper S in the width direction thereof that is pinched by the transport roller pair 18, and the regional area that corresponds to the pinched area along the transport direction. Accordingly, the area of the continuous paper S that is positioned immediately above the light-transmissive glass 41 experiences almost no deformation in the direction that lifts off from the support surface 24*a* of the support plate 24, even if the continuous paper S has expanded. In other words, the top surface of the light-transmissive glass 41 remains covered from above by the continuous paper S even if the continuous paper S has expanded. As a result, in the case where some of the ink ejected from the recording head 31 has accumulated above the support surface 24*a* of the support plate 24 as ink mist, the ink mist can be suppressed from adhering to the light-transmissive glass 41.

The aforementioned embodiment may be changed to the embodiments described hereinafter as well.

In the aforementioned embodiment, the heater that heats and fixes the ink ejected onto the continuous paper S may be disposed downstream from the support platform 22 in the transport direction of the continuous paper S. In addition, the configuration may be such that the heater that heats and fixes the ink ejected onto the continuous paper S is omitted.

In the aforementioned embodiment, the area of the continuous paper S that is detected by the image capturing unit 30 may be an area that is skewed from the center of the segmented roller members 21 in the width direction of the continuous paper S and an area that corresponds thereto along the transport direction, as long as that area is a pinched area in the width direction of the continuous paper S that is pinched by the segmented roller members 21 and an area that corresponds thereto along the transport direction.

In the aforementioned embodiment, the image capturing unit 30 may be disposed in a location that is upstream or downstream from the support platform 22 in the transport path of the continuous paper S. In addition, the image capturing unit 30 may detect the amount by which the continuous paper S is transported from the surface of the side of the continuous paper S that is on the opposite side as the side that is supported by the support platform 22.

In the aforementioned embodiment, the image capturing unit 30 may be disposed upstream from the transport roller pair 18 in the transport path of the continuous paper S.

In the aforementioned embodiment, the transport amount detection unit that detects the amount by which the continuous paper S is transported without making contact therewith is not limited to an optical sensor; for example, a sonic sensor that imparts sonic waves on the continuous paper S and detects the amount by which the continuous paper S is transported (or a transport speed) based on changes in the frequency of the sonic waves that are reflected by the continuous paper S may be employed.

In the aforementioned embodiment, the transport unit that pinches the continuous paper S and imparts a transport force thereon is not limited to a pair of rollers; for example, a configuration including an endless transport belt that moves cyclically while supporting the continuous paper S and a slave roller that undergoes slave rotation while pinching the continuous paper S against the transport belt may be employed instead.

In the stated embodiment, the target is not limited to an elongated target wrapped in roll form, and a single sheet form target may be employed instead.

In the aforementioned embodiment, the material of the target is not limited to the paper, and cloth, a resin film, a resin sheet, a metallic sheet, or the like may be employed as well.

In the aforementioned embodiment, a serial-type or lateral-type printer may be employed as the printer 11.

In the above embodiment, the liquid ejecting apparatus is embodied as the ink jet printer 11, but a liquid ejecting apparatus that ejects or expels another liquid aside from ink may serve as the embodiment instead. The invention can also be applied in various types of liquid ejecting apparatuses including liquid ejecting heads that eject minute liquid droplets. Note that "droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid state, including liquids having high or low viscosity; fluid states such as sol, gel water, other inorganic agents, inorganic agents, liquid solutions, liquid resins, and liquid metals (metallic melts); furthermore, in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of liquid ejecting apparatuses: liquid ejecting apparatus that eject liquids including materials such as electrode materials, coloring materials, and so on in a dispersed or dissolved state for use in the manufacture and so on of, for example, liquid-crystal displays, EL (electroluminescence) displays, front emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatus that eject an etching liquid such as an acid or alkali onto a substrate or the like for etching. The invention can be applied to any type of these liquid ejecting apparatuses.

In the aforementioned embodiment, the target transport apparatus is not limited to being provided in a recording apparatus that executes a recording process on a target, and may be a target transport apparatus provided in various types of processing apparatuses that carry out various types of processes on targets.

The entire disclosure of Japanese Patent Application No. 2011-255860, filed Nov. 24, 2011 is expressly incorporated by reference herein.

What is claimed is:

1. A target transport apparatus comprising:

a transport unit that includes a plurality of pinching portions disposed at intervals along a width direction that intersects with a transport direction of a target, the transport unit imparting a transport force on the target by the plurality of pinching portions pinching the target at a plurality of pinched areas; and a transport amount detection unit, disposed at a location downstream from the plurality of pinching portions in the transport direction within a boundary of a width of one of the plurality of pinching portions, wherein the transport amount detection unit detects an amount by which the target is transported, and wherein the transport amount detection unit is configured to capture an image of a surface of the target at a location that corresponds to at least one of the pinched areas of the target along the transport direction.

2. The target transport apparatus according to claim 1, further comprising:

a support member that supports the target to contact with the surface of the target transported by the transport unit;

wherein the transport amount detection unit is formed only on a side opposite to a side on which the plurality of pinching portions are formed relative to the target, and the transport amount detection unit is embedded in the support member.

3. The target transport apparatus according to claim 1, wherein the transport amount detection unit includes an imaging sensor configured to sense the image.

4. The target transport apparatus according to claim 1, further comprising a hole formed in a support member and having light-transmissive glass disposed therein that does not make contact with the target.

5. A liquid ejecting apparatus comprising: a liquid ejecting head that ejects a liquid onto the target; and the target transport apparatus according to claim 1.

6. The liquid ejecting apparatus according to claim 5, wherein the liquid ejecting head is provided downstream from the transport unit in the transport direction of the target.

7. The target transport device of claim 1, wherein the transport amount detection unit is configured to capture an image of a bottom surface of the target.

8. The target transport device of claim 1, wherein the transport amount detection unit is positioned below a bottom surface of the target.

* * * * *